United States Patent [19]

Ogg

[11] 3,964,745

[45] June 22, 1976

[54] SPRING MOUNTED PITCHING DECK AND PROJECTILE FOR IMPACTING THEREON

[76] Inventor: Andrew L. Ogg, 801 Tanglewood, Bryan, Tex. 77801

[22] Filed: Feb. 24, 1975

[21] Appl. No.: 552,692

[52] U.S. Cl. ..... 273/95 R; 273/106 B; 273/105 R

[51] Int. Cl.[2] ..... A63B 71/00

[58] Field of Search ..... 273/95 R, 102 R, 102 S, 273/105 R, 106 R, 106 B

[56] References Cited

UNITED STATES PATENTS

| | | | |
|---|---|---|---|
| 324,189 | 8/1885 | Thomas | 273/105 R |
| 738,401 | 9/1903 | Branham | 273/95 R |
| 1509,491 | 9/1924 | Sawyer | 273/106 B |
| 2,640,699 | 6/1953 | Garbo | 273/106 B |
| 2,722,420 | 11/1955 | Adamson | 273/102 S |
| 2,744,752 | 5/1956 | Arnold | 273/105 R |
| 2,828,964 | 4/1958 | Horton | 273/95 R |
| 3,001,791 | 9/1961 | Atwood | 273/105 R |
| 3,201,128 | 8/1965 | Palovik | 273/95 R |
| 3,573,869 | 4/1971 | Dockett | 273/95 R |
| 3,731,930 | 5/1973 | Jeandron | 273/105 R |

*Primary Examiner*—Richard C. Pinkham
*Assistant Examiner*—Marvin Siskind
*Attorney, Agent, or Firm*—Arnold, White & Durkee

[57] ABSTRACT

A pitching deck apparatus with a resiliently mounted upper surface, having a pad of woven material on the surface and a target area in the approximate center thereof. In use, flat discs are propelled toward the surface of the pitching deck, the object being to direct the disc accurately enough to stop in the recess portion of the upper surface of the pitching deck. The discs may be of metal or other suitable material and may have a rubber or elastomeric covering thereon such that the cooperation between the resilient mountings of the upper surface, the woven material covering the upper surface and the impinging disc closely simulate the surface characteristics of the ground.

8 Claims, 9 Drawing Figures

FIG. 1
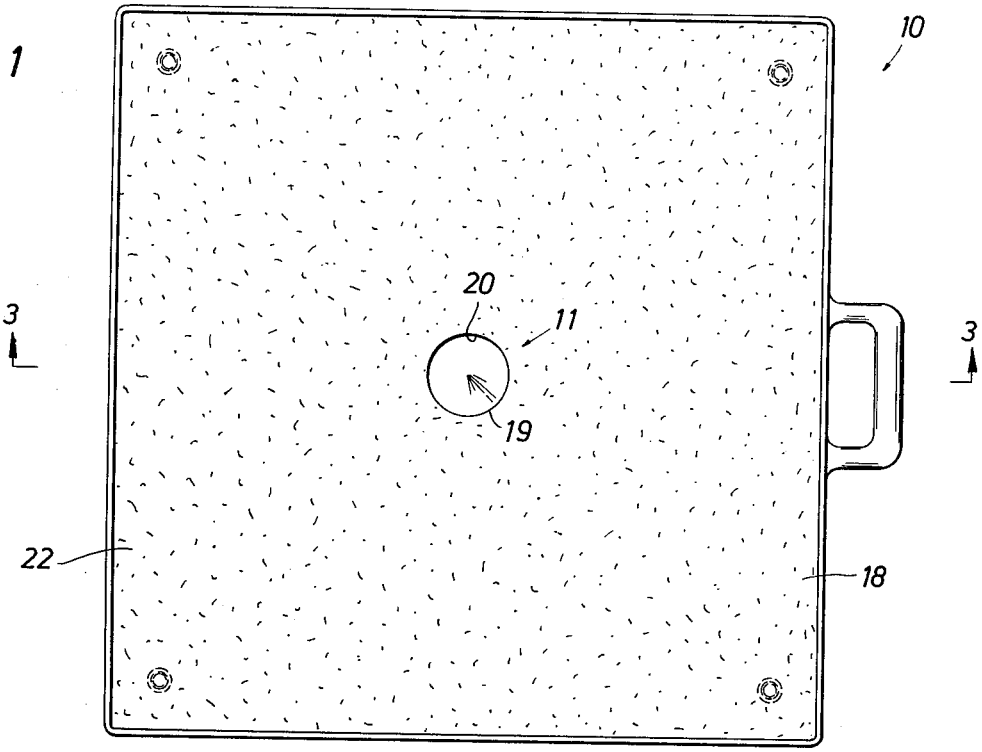
FIG. 2
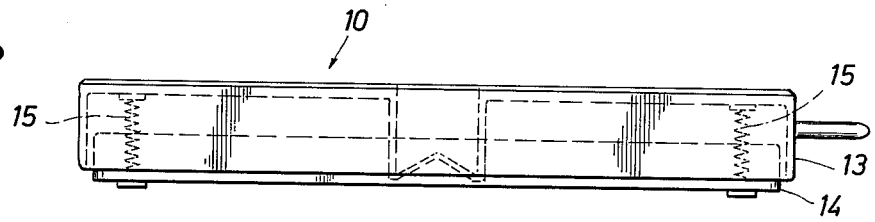
FIG. 3
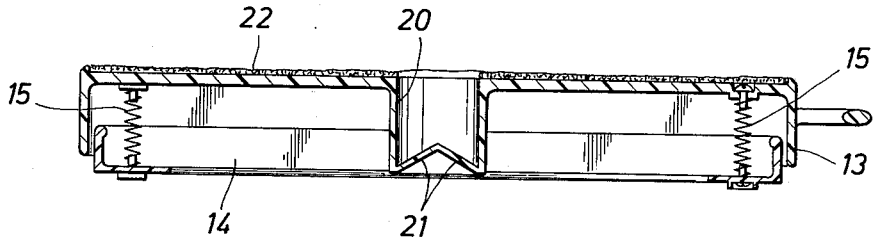
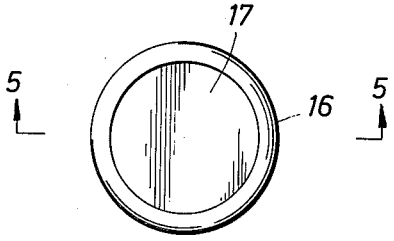
FIG. 4
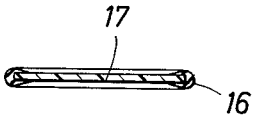
FIG. 5

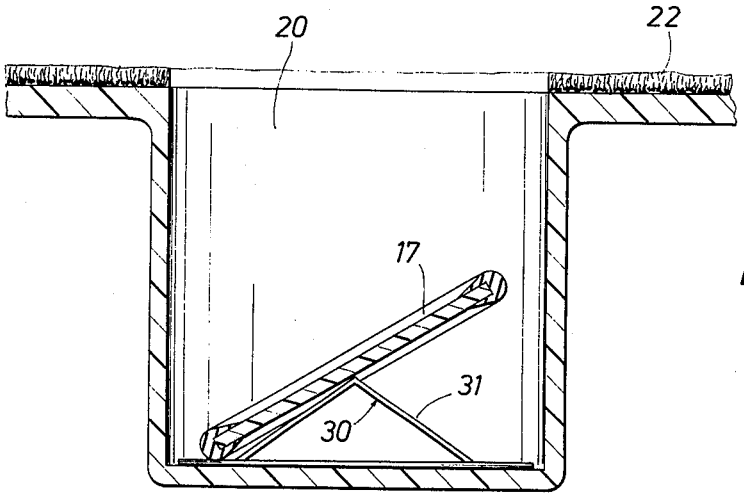
FIG. 3A
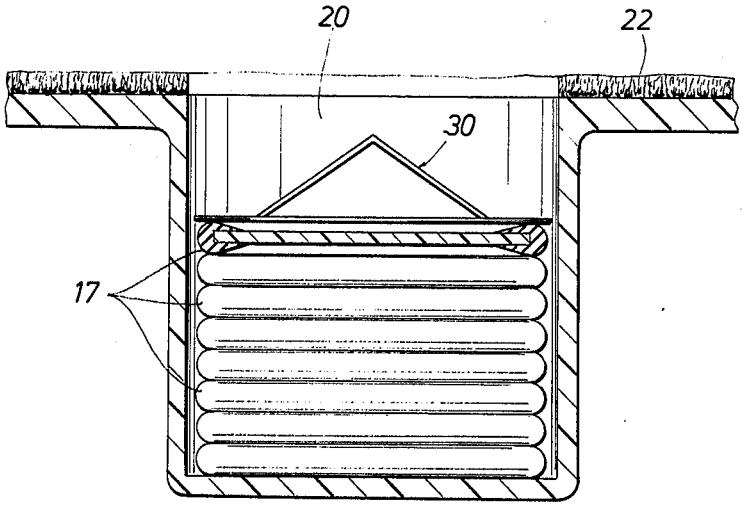
FIG. 3B
FIG. 3C
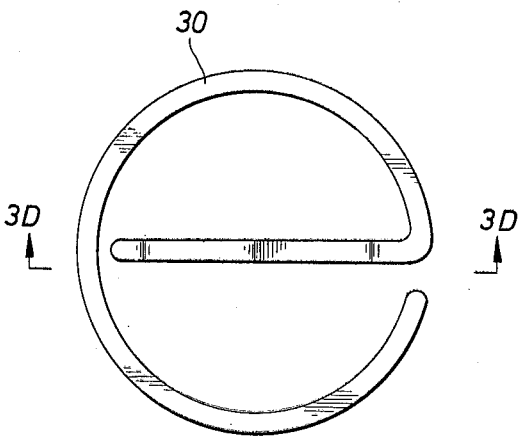
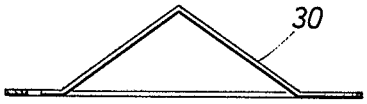
FIG. 3D

SPRING MOUNTED PITCHING DECK AND PROJECTILE FOR IMPACTING THEREON

This invention relates to a pitching deck apparatus and more particularly to a resiliently mounted upper frame with a woven fabric covering the surface thereof, the fabric comprising a pad which receives a pitched or thrown disc that will remain on the surface in the event the disc misses a target area. The fabric comprising the pad is of a particular weave which when combined with the shock-absorbing characteristics of the upper frame resilient mountings, minimizes the recoil or bounce of the disc being directed thereat.

One feature of this invention is to provide a playing surface comprising a woven fabric affixed to the upper surface of an upper frame support member and having a target area, the surface friction characteristics acting in concert with the resilient mountings to minimize bounce of a disc or other projectile pitched or thrown toward the target area.

It is another feature of this invention to provide a pitching deck apparatus with upper and lower frames, the upper frame being resiliently mounted with respect to the lower frame, and having a woven fabric material affixed to the horizontal upper surface, and wherein the unique combination of the surface characteristics of the woven material and the spring mounting provide for minimized bounce characteristics of a disc directed at a target area so as to minimize the possibility of the disc leaving the surface area in the event the target is missed.

The features and advantages of this invention will be better understood from the detailed description following, with the accompanying drawings forming a part of this application and showing typical embodiments of the invention and how it may be used.

IN THE DRAWINGS

FIG. 1 is a plan view of the pitching deck apparatus.

FIG. 2 is a side view of the pitching deck apparatus.

FIG. 3 is a sectional view taken along lines 3—3 of FIG. 1.

FIG. 3A illustrates an alternative embodiment of the central portion of the pitching deck apparatus.

FIG. 3B shows the recess of FIG. 3A with a plurality of discs therein.

FIG. 3C is a top view of a spring used in the recess of FIG. 3A.

FIG. 3D is an elevation view of the spring of FIG. 3C.

FIG. 4 is a plan view of a circular disc.

FIG. 5 is a sectional view of the disc of FIG. 4, taken along lines 5—5.

The most elementary embodiment of this invention is illustrated in FIGS. 1 and 2. There is shown a pitching deck apparatus generally illustrated at 10, having a target at 11 on the upper surface thereof. Target 11 may take any convenient location, however, in the preferred embodiment of this invention, the target is spaced approximately in the center of the upper surface of pitching deck apparatus 10. The upper surface of the pitching deck apparatus 10 is covered with a woven fabric 12, which may be a carpet material such as "Fresh Dimension" manufactured by Ozite.

Now referring to FIG. 2, the pitching deck apparatus 10, in one embodiment may comprise an upper frame structure 13, a lower frame structure 14, the two frame structures 13 and 14 being joined together through resilient mountings 15. Lower frame member 14 has affixed to its upper surface a plurality of springs 15 which are likewise affixed to the lower or underneath surface of upper frame support 13.

The details of the apparatus may be viewed by reference to FIGS. 1 and 2. In FIG. 1, pitching deck apparatus 10 is generally rectangular in overall configuration, although it may take any convenient shape. In the approximate center of the surface of upper frame structure 13 there may be a recess 20 which generally corresponds to a target area. Of course, there could be a plurality of recesses in the upper surface, each recess corresponding to a target area having a different size or shape. Around the perimeter of upper frame structure 13, there is a raised lip 18 for containing pad 22. It is understood the raised lip may be replaced by merely arranging the woven pad to join the edge of the upper surface of frame 13. Pad 22 which may be any conveniently available carpet-like material of a close weave, is affixed to the upper or flat surface of upper frame structure 13, and has a cut out or space 19 in the approximate center thereof. Cut out 19 corresponds in location to previously mentioned recess 20. Lower frame structure 14, which may be slightly smaller than upper frame structure 13, supports upper frame structure 13 through springs 15. Springs 15 have a suitable spring constant, the reaction of which to an impact of a pitched disc or other projectile upon the upper surface of upper frame structure 13, cooperates with the surface frictional and recoil characteristics of pad 22 to produce a playing surface with characteristics similar to that of the ground.

Referring to FIG. 3, there is shown in section view a portion of pitching deck apparatus 10. Recess 20 is of a diameter slightly larger than disc 17 (FIG. 4) and forms the principal target area for directing the projectiles toward. The bottom portion of recess 20, rather than being horizontal is formed of two inclined surfaces 21, which facilitates removal of disc 17 from recess 20. If, for example, the bottom of recess 20 were horizontal, the disc being only slightly smaller in diameter than recess 20 would be difficult in removing disc 17 from recess 20. An alternative embodiment of the apparatus may be as shown in FIG. 3A. Therein spring 30 with a raised portion 31 may be inserted into recess 20, thereby providing a similar inclined surface to facilitate removal of a disc 17. Further as illustrated in FIG. 3B, a plurality of discs 17 may be stored within recess 20, with spring 30, inserted on top of discs 17, serving to prevent discs 17 from falling therefrom. Spring 30 may take any convenient form, such as that illustrated in FIGS. 3C and 3D.

Springs 15 of which there may be three or more, provide a resilient mounting between upper frame structure 13 and lower frame structure 14. The respective frame structures 13 and 14 do not otherwise contact one another in their normal configuration.

As previously mentioned, one feature of this apparatus is to provide a playing surface for a game involving the pitching of discs toward a target area on a playing surface, with the surface closely approximating the surface frictional and recoil characteristics of the ground. Pad 22 is a relatively closely woven fabric material, such as what is commonly referred to as "kitchen" carpet, of a desired thickness and providing in combination with springs is, the desired resiliency and recoil characteristics. Springs 15, functioning as resilient mountings for the horizontal surface of upper frame structure 13 cooperate with the aforementioned characteristics of pad 22 to produce the desired landing characteristics of the projectile or disc impacting upon pad 22. Pad 22 also provides the surface resistance necessary to prevent an impacting disc from sliding or slipping over the edge of pitching deck apparatus 10.

With reference to FIGS. 4 and 5, pitching disc 17 is illustrated. The disc also has sufficient weight when thrown at the pitching deck apparatus 10, and landing on the upper surface thereof, to exhibit the desired recoil and sliding characteristics. Ideally, the disc will remain in relatively the same position as its first impact. However, when pitching a disc similar to disc 17 on a natural surface, such as the ground, there is encountered a small amount of movement generally in the direction of the line of flight caused by slipping after initial impact. This characteristic is retained through the unique combination of the surface frictional and recoil characteristics of pad 22 in combination with the resilient mountings or springs 15 connecting upper frame structure 13 to a suitable base. It will also be noted from FIG. 5 that a rubber or elastomeric coating is provided around the outer perimeter of the disc 17. As previously mentioned, the disc is of sufficient weight to permit directing it toward pitching dick apparatus 10 from a considerable distance, for example, approximately 15 feet. The weight of disc 17 causes a sufficiently high impact force as could result in damage to pitching deck apparatus 10 if the point of impact is other than upon pad 22. Thus, the elastomeric coating 16 provides a sufficient cushioning to prevent damage to pitching deck apparatus 10 in the event of impact therewith. Elastomeric coating 16 additionally provides for an increased surface or frictional resistance between disc 17 and pad 22 to achieve the desired sliding characteristics of disc 17 after impact.

As will be apparent one principal feature of this invention is the ease with which the apparatus may be transported. Being of an overall size somewhat less than 36 inches by 36 inches, it is convenient to carry the pitching deck apparatus to any location, and obviate the necessity of preparing a playing surface for a game conducted according to the following general rules.

The game has many variations, however, the simpliest form as illustrated in FIG. 1, is played by two or four players. Disc 17 is directed toward pitching deck apparatus 10 from a distance of approximately fifteen feet. Each player having one or more discs 17, in turn may toss a disc toward pitching deck apparatus 10 trying to cause disc 17 to come to rest within the recess 20 which comprises the target area. If more than one player succeeds in directing a disc to land within recess 20, the scores awarded for a disc landing in the target area are cancelled, with the score being awarded to the next closest disc to the target area. Other scoring is determined upon the basis of the closest disc to target area 11, but may also take the form of delineated target areas of different scoring values over the various areas of pad 22.

This game shall not be limited to any one particular form of the apparatus, but may extend to any portable playing surface providing the desired surface frictional characteristics closely simulating that of the ground. The discs used may vary in weight or size, however, the relation between the recess 20 and disc 17 should be such as to prevent a disc from being easily placed within the recessed target area.

The invention described in detail in the foregoing specification is subject to modifications, such as a change in the shape of the surface of pitching deck apparatus 10, or changing the target area for a circular recess to a rectangular recess with an accompanying change in the shape of the disc, without departing from the principle and spirit thereof. The scope of this invention is not to be limited by the described embodiment, the only limitations being those defined by the following claims.

What I claim is:

1. A game apparatus comprising:

a horizontal upper frame structure affixed to a lower support with resilient mountings, said upper frame structure having a flat upper surface with a target area in the approximate center thereof;

a pad affixed to the flat upper surface of said frame structure, said pad having surface frictional characteristics closely approximating a dirt surface, and a space in proximity to the target area of said upper frame support member; and a projectile for directing at said target area, said projectile having surface frictional characteristics which in combination with the pad and the resiliently mounted upper frame support cause the projectile to travel a minimum distance after impacting the pad.

2. The game apparatus of claim 1, wherein said pad comprises a tightly woven carpet material.

3. The game apparatus of claim 1, wherein said lower support comprises a lower frame structure.

4. The game apparatus of claim 3, wherein said resilient mountings are spring members.

5. The game apparatus of claim 1, wherein said projectile comprises a flat metal disc with an elastomeric coating thereon.

6. A pitching deck apparatus, comprising:

a lower frame support structure;

an upper frame structure attached to said lower frame support structure through resilient mountings said upper frame structure having a flat upper surface with a target area thereon, said resilient mountings including a plurality of resilient members affixed to said upper and lower frame structures adjacent the edge of said upper and lower frames, said resilient members for permitting controlled movement between said upper and lower frames for absorbing the energy of an object impinging thereon;

a pad affixed to the upper surface of said upper frame structure, said pad having recoil characteristics which encourage a projectile landing thereon to cease movement within a relatively short distance, and said pad having an opening therein to accommodate the target area of the upper frame support; and a projectile for directing at said target area, said projectile having surface friction characteristics which in concert with the pad and the resiliently mounted upper frame structure cause the projectile to travel a minimum distance after impacting the pad.

7. The pitching deck apparatus of claim 6, wherein said resilient mountings are spring members.

8. The pitching deck apparatus of claim 6, wherein said projectile comprises a flat metal disc with an elastomeric coating thereon.

* * * * *